US008942067B2

(12) United States Patent
Villar

(10) Patent No.: US 8,942,067 B2
(45) Date of Patent: Jan. 27, 2015

(54) MECHANISM FOR DISPLAYING AND CORRECTING THE STATE OF TWO DIFFERENT TIME MEASURABLE QUANTITIES

(71) Applicant: Omega S.A., Bienne 4 (CH)

(72) Inventor: Ivan Villar, Bienne (CH)

(73) Assignee: Omega S.A., Bienne (CH)

( * ) Notice: Subject to any disclaimer, the term of this patent is extended or adjusted under 35 U.S.C. 154(b) by 78 days.

(21) Appl. No.: 13/835,798

(22) Filed: Mar. 15, 2013

(65) Prior Publication Data

US 2013/0250737 A1 Sep. 26, 2013

(30) Foreign Application Priority Data

Mar. 23, 2012 (EP) ..... 12160931

(51) Int. Cl.

| | |
|---|---|
| ***G04B 19/26*** | (2006.01) |
| ***G04B 19/253*** | (2006.01) |
| ***G04B 19/25*** | (2006.01) |
| ***G04B 27/02*** | (2006.01) |

(52) U.S. Cl.

CPC ..... *G04B 19/25333* (2013.01); *G04B 19/25* (2013.01); *G04B 19/25373* (2013.01); *G04B 19/268* (2013.01); *G04B 27/026* (2013.01)

USPC ..... 368/15; 368/35; 368/37; 368/184; 368/185

(58) Field of Classification Search

USPC ..... 368/15, 18, 35, 37, 38, 184, 185, 190

See application file for complete search history.

(56) References Cited

U.S. PATENT DOCUMENTS 3,818,692 A 6/1974 Zaugg et al.

(Continued)

FOREIGN PATENT DOCUMENTS

| | | |
|---|---|---|
| CH | 394 959 | 3/1965 |
| CH | 589 880 | 7/1977 |
| CH | 609 564 | 3/1979 |
| DE | 86 10 798.4 | 6/1986 |

(Continued)

OTHER PUBLICATIONS

European Search Report issued Oct. 9, 2012, in Patent Application No. EP 12 16 0931, filed Mar. 23, 2012 (With English-language Translation).

*Primary Examiner* — Amy Cohen Johnson
*Assistant Examiner* — Jason Collins
(74) *Attorney, Agent, or Firm* — Oblon, Spivak, McClelland, Maier & Neustadt, L.L.P.

(57) ABSTRACT

A mechanism for displaying and correcting a state of two different time measurable quantities for a timepiece includes a movement driving a first display mechanism to display a first measurable time quantity and a second display mechanism to display a second measurable time quantity, and including an adjusting member. The first and second display mechanisms respectively include first and second drive mechanisms sharing a common drive mechanism driven by the movement, and controlling a driving of one of the display mechanisms by instantaneous jumps and of the other by dragging. The display mechanisms respectively include a first and a second correction mechanism, sharing a common correction mechanism driven by the adjusting member independent of the common drive mechanism, including a friction safety device.

7 Claims, 10 Drawing Sheets

(56) References Cited

U.S. PATENT DOCUMENTS

| | | | | |
|---|---|---|---|---|
| 3,892,067 | A | 7/1975 | Meylan-Piguet | |
| 3,928,552 | A | 12/1975 | Winchell et al. | |
| 8,760,975 | B2 * | 6/2014 | Rudaz | 368/28 |
| 2003/0151981 | A1 | 8/2003 | Vernay et al. | |
| 2005/0232085 | A1 | 10/2005 | Scheufele | |
| 2007/0109916 | A1 | 5/2007 | Bron | |

FOREIGN PATENT DOCUMENTS

| | | | |
|---|---|---|---|
| EP | 1 335 253 | A1 | 8/2003 |
| EP | 1 586 962 | A2 | 10/2005 |
| EP | 1 785 783 | A1 | 5/2007 |
| FR | 2.165.705 | | 8/1973 |
| FR | 2.203.105 | | 5/1974 |
| GB | 1 365 428 | | 9/1974 |

* cited by examiner

MECHANISM FOR DISPLAYING AND CORRECTING THE STATE OF TWO DIFFERENT TIME MEASURABLE QUANTITIES

This application claims priority from European Patent Application No. 12160931.7 filed Mar. 23, 2012, the entire disclosure of which is incorporated herein by reference.

FIELD OF THE INVENTION

The invention concerns a timepiece mechanism for displaying and correcting the state of two different time measurable quantities for a timepiece or a scientific apparatus, comprising a timepiece movement which includes or drives at least one first display mechanism for the display of a first measurable time quantity and one second display mechanism for the display of a second measurable time quantity, said movement including an adjusting member.

The invention also concerns a timepiece incorporating this type of display mechanism.

The invention concerns the fields of horology and scientific equipment for displaying periodic phenomena.

The invention more particularly concerns the field of horology, and more particularly timepieces with complications connected to the time display, called calendar mechanisms, such as the date display, moon phase display, tide display, day/night display, AM/PM display or similar.

BACKGROUND OF THE INVENTION

The simultaneous display of several time measurable quantities is a prized complication in high-end watchmaking. However, it is difficult to ensure the safety of display mechanisms when the correction mechanisms are being operated. The action of the correction mechanisms may interfere with an operation of driving one of said display mechanisms, during a preparatory phase for said driving operation or during the actual driving operation. For example, correction of the date or time as midnight approaches is generally prohibited, or at least not recommended. The problem is particularly acute when several display mechanisms coexist. Some safety devices properly manage correction operations carried out in a dedicated position of the stem, but there is still a risk when the user envisages performing corrections, in particular in the direction opposite to normal operation, via the time-setting motion work.

CH Patent Application No. 394 959 A in the name of TAVANNES discloses a self-winding watch, with a manual winding and time-setting device and a date mechanism, comprising a lever pivoting about the axis of the crown wheel, and carrying an intermediate wheel constantly meshed with said wheel. This lever is controlled by a pull-out piece hinged to the winding stem so that it can occupy three positions: one where the intermediate wheel is inactive, another where it is meshed with the date-setting mechanism and another where it is meshed with the motion work. The crown wheel is constantly meshed with the winding mechanism. The lever carries a stud on which the intermediate time-setting wheel is fitted, the latter being friction fitted onto a shoulder of a drive cam of the date mechanism. A friction spring holds the intermediate wheel and cam assembled to each other. Depending upon the position of the pull-out piece and the lever, the trajectory of the cam intersects the trajectory of the teeth of the date disc so that the cam drives the date disc by a value slightly less than one step of its toothing, with a jumper spring performing the additional rotation.

DE Utility Model No. 86 10 798 U1 in the name of SCHWARTZ discloses a moon phase and tide indicator device, wherein the moon phase wheel is actuated by one tooth of an actuator lever returned by a jumper spring. This actuator lever is coupled to a first arm of a control lever, the other arm of which cooperates with a pin carried by a cam, which can be uncoupled from another pin carried by a control wheel, which pivots about the same axis as said cam.

CH Patent No. 589 880 B5 in the name of SSIH discloses a watch control mechanism with two calendar members, the date and the day of the week, which includes a single correction lever pivoting in a push manner fit on an arbour integral with the intermediate time-setting wheel, said arbour is engaged in an oblong hole of a bar in a position determined by the pinion lever sliding against a spring, the correction lever carrying a pivotally mounted corrector wheel set, which is permanently meshed with the intermediate wheel and alternately with one of the two calendar members.

SUMMARY OF THE INVENTION

The invention proposes to provide a reliable, simple and economical solution to the safety of display mechanisms when the correction mechanisms are being operated. The action of the correction mechanisms may interfere with an operation of driving one of said display mechanisms, during a preparatory phase for said driving operation or during the actual driving operation. The invention applies in particular to the case where, using the same adjusting member, the user can perform corrections on mechanisms for displaying different measurable quantities.

The invention therefore concerns a timepiece mechanism for displaying and correcting the state of two different time measurable quantities for a timepiece or scientific apparatus including a timepiece movement, which comprises or drives at least a first display mechanism for the display of a first time measurable time quantity and a second display mechanism for the display of a second measurable time quantity, said movement comprising an adjusting member, characterized in that said first display mechanism and said second display mechanism respectively comprise a first drive mechanism and a second drive mechanism, which share a common drive mechanism, which is driven by said movement and which controls the driving of one of said first display mechanism and said second display mechanism by instantaneous jumps, and the driving of the other of said first display mechanism and said second display mechanism in a dragging manner, and in that said first display mechanism and said second display mechanism respectively comprise a first correction mechanism and a second correction mechanism, which share a common correction mechanism which is driven by said adjusting member, which is independent of said common drive mechanism and which includes at least one friction safety device preventing any correction being performed when an instantaneous display jump is being prepared or carried out.

The invention also concerns a timepiece incorporating this type of display mechanism.

BRIEF DESCRIPTION OF THE DRAWINGS

Other features and advantages of the invention will appear more clearly upon reading the following detailed description, with reference to the annexed drawings, in which.

DETAILED DESCRIPTION OF PREFERRED EMBODIMENTS

Figure 1:
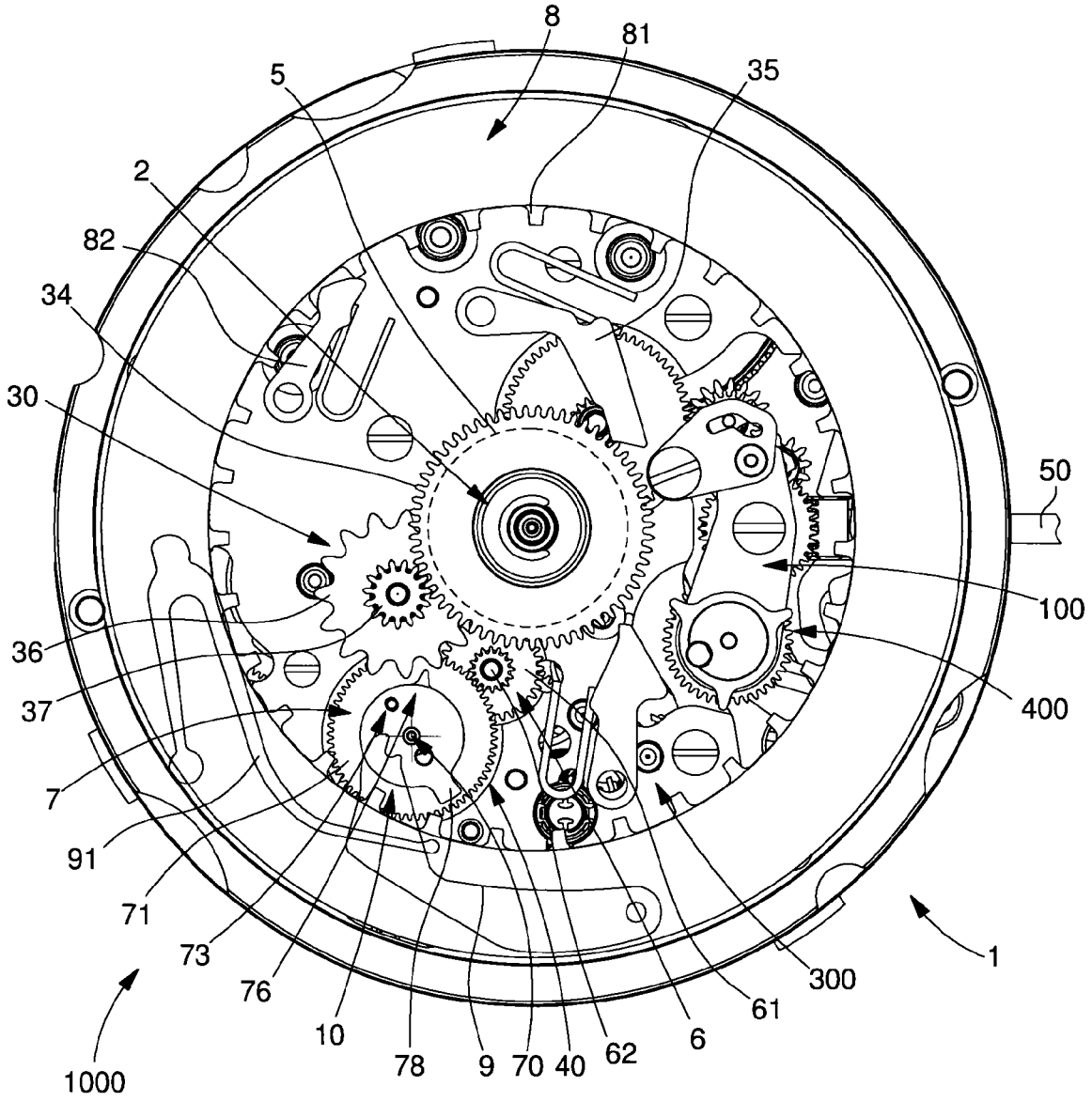
FIG. 1 shows a schematic, partial, front, transparent view of certain components, a timepiece, including a dragging moon phase mechanism according to the invention and an instantaneous date display mechanism, sharing a common drive mechanism and a common correction mechanism according to the invention.
Figure 2:
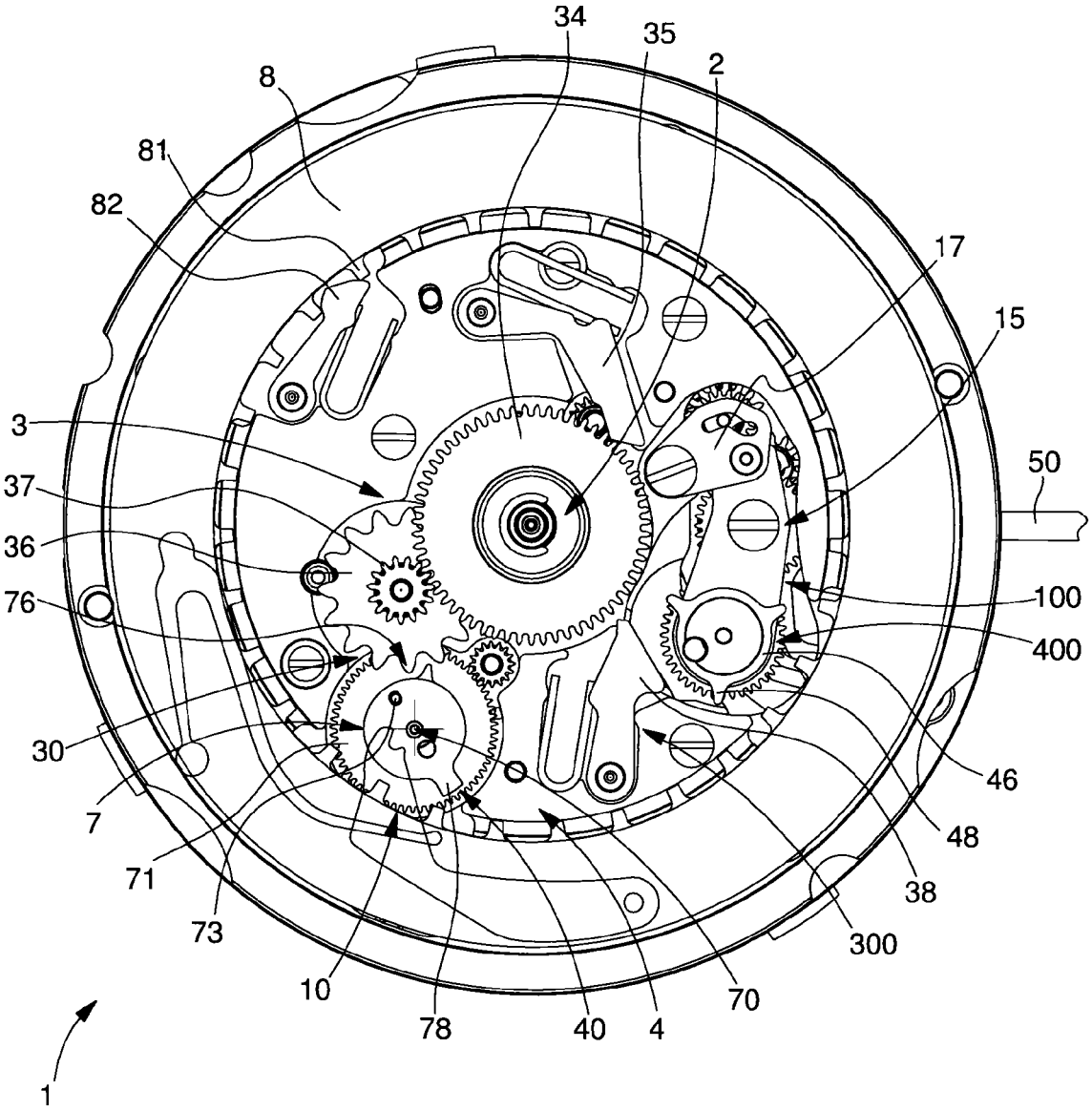
FIG. 2 shows a schematic, front, non-transparent view of the display mechanism of FIG. 1.

The invention concerns the fields of horology and scientific equipment for displaying periodic phenomena.

The invention more particularly concerns the field of horology, and more particularly timepieces 1000 with complications connected to the time display, called calendar mechanisms, such as the date display, moon phase display, tide display, day/night display, AM/PM display or similar. These complications are driven by a movement 2.

The invention therefore concerns a timepiece mechanism 1 for displaying and correcting the state of at least two different time measurable quantities, notably in a particular application of periods that differ from each other, for a timepiece 1000 or a scientific apparatus comprising a timepiece movement 2. This movement 2 includes or drives at least: a first display mechanism 3 for displaying a first measurable time quantity and a second display mechanism 4 for displaying a second measurable time quantity. This movement 2 includes an adjusting member 50, such as a stem operated by a crown, or similar.

According to the invention, said first display mechanism 3 and second display mechanism 4 respectively include a first drive mechanism 30 and a second drive mechanism 40, which share a common drive mechanism 10, which is driven by movement 2 and which controls the driving of one of said first display mechanism 3 and said second display mechanism 4 by instantaneous jumps, and which controls the driving of the other of said first display mechanism 3 and said second display mechanism 4 in a dragging manner.

In the event that movement 2 has or drives additional display mechanisms other than said first display mechanism 3 and said second display mechanism 4, each said additional display mechanism also includes a drive mechanism one part of which is formed by said common drive mechanism 10.

According to the invention, combined with said drive mechanisms, first display mechanism 3 and second display mechanism 4 respectively include a first correction mechanism 300 and a second correction mechanism 400, which share a common correction mechanism 100, which is driven by adjusting member 50. This common correction mechanism 100 is independent of the common drive mechanism 10 and includes at least one friction safety device 54 preventing a correction from being performed when an instantaneous display jump is being prepared or carried out.

In the event that movement 2 has or drives additional display mechanisms other than said first display mechanism 3 and said second display mechanism 4, each said additional display mechanism also includes a correction mechanism one part of which is formed by said common correction mechanism 100.

The invention is described below in a particular, non-limiting embodiment, where mechanism 1 is a moon phase and date mechanism 1 for a timepiece 1000 or a scientific apparatus including a timepiece movement 2. The first display mechanism 3 is a moon phase display, and the second display mechanism 4 is a date mechanism.

The moon phase display mechanism 3 includes a dragging moon phase drive mechanism 30, and a moon phase correction mechanism 300.

The second date display mechanism 4 includes a date drive mechanism 40 which jumps instantaneously, and a date correction mechanism 400.

Movement 2 includes or drives a date mechanism and/or a mechanism for counting a reference period equal to the duration of one earth day or an integer multiple or sub-multiple thereof. This movement 2 has an output 5 locked on said reference period and driving a main reference display. Preferably, output 5 is formed, as seen in a preferred but non-limiting embodiment illustrated in the Figures, by an hour wheel 5.

Moon phase drive mechanism 30 and date drive mechanism 40 largely use a common drive mechanism 10. Drive mechanism 10 includes, in the particular embodiment illustrated by the Figures, an intermediate date wheel 6 which meshes, via a roller 61 comprised therein, with hour wheel 5. This roller 61 is integral with a pinion 62, which meshes with a drive wheel plate 71 comprised in a drive wheel set 7 pivotally moveable about an axis 70.

This drive wheel 71, for driving the date and days, has an oblong aperture 72, in a sector centred on axis 70, in which a pin 73 moves. This pin 73 pivots integrally with a stack, coaxial to drive wheel 71 on axis 70, of three stages all pivoting integrally:

- a cam 74 which cooperate with a release lever 9, which is returned towards said cam 74 by a release spring 91;
- a moon phase drive disc 75 including a radial finger 76 which, depending upon its angular position, may interfere for the driving thereof with the trajectory of a star wheel 36 comprised in an intermediate wheel 33, used for the moon phase drive mechanism 30. This star wheel 36 includes a pinion 37 driving a wheel 34, which is, in particular, a wheel with 59 teeth, which is held in position by a jumper spring 35;

a date drive disc 77, used for date drive mechanism 40, and which includes a date drive finger 78, whose trajectory, depending on the angular position of disc 77, interferes or does not interfere with an inner toothing 81 of a pivotally moveable date indicator 8 held by a date jumper spring 82, in order to pivot said date indicator 8 once per day, at midnight, through a single step.

The travel of pin 73 in oblong aperture 72 defines a making good period. During this making good period, the moon phase drive disc 75 is not driven.

Likewise, oblong aperture 72 allows the date mechanism to be wound or let down, since the date drive disc 77 is also not driven during the making good period.

The length of this making good period is determined by the development of oblong aperture 72. Advantageously, it is chosen to be closes to seven and a half hours, which corresponds to a central angle of 110° for aperture 72, said angle of 110° being broken down into a first angle of around 90° necessary for the driving operation, to which is added a second safety angle, chosen here in a non-limiting manner to be 20°. These angles naturally depend on the geometrical construction of the calibre: for example, as seen in the Figures, the 90° angle corresponds in this particular case to the central angle $\alpha$ during which there is interference between the trajectory of drive finger 78 with that of inner toothing 81.

On the periphery of cam 74 there are various portions which are joined in pairs forming hollows or beaks.

Under the action of release spring 91, release lever 9 presses on cam 74 and, apart from certain rest positions of cam 74, tends to pivot said cam, and thus to drive in rotation pin 73, moon phase drive disc 75 and date drive disc 77 which rotate integrally with each other.

Preferably, drive wheel set 7 is made in accordance with the features of EP Patent No. 2 015 146 in the name of OMEGA SA, in particular as regards the profile of cam 74 and the operation thereof, according to the position of pin 73 in oblong aperture 72. Thus, the profile of said cam 74 is particularly designed so as to release drive finger 78 from date toothing 81 after said toothing 81 has been driven.

The common drive mechanism 10 according to the invention thus combines a drive wheel set according to EP Patent No. 2 015 146 with the moon phase drive disc 75. Only date drive disc 77, with its date drive finger 78, experiences the abrupt variations caused by the steep ramps of cam 74, which results in an instantaneous operation of the date mechanism, when, at midnight, a beak of release lever 9 crosses a peak of cam 74.

Whereas the moon phase drive disc 75 only experiences the slow movements of pin 73 and is thus dragged by the motion of hour wheel 5, except during the making good periods when it remains stopped.

The winding of the moon phase mechanism and of the date mechanism, is thus performed gradually during the entire day, so as avoid the requirement for a large instantaneous consumption of energy. Advantageously, the moon phase display change time is chosen to be at a time when the other mechanisms, such as the date mechanism, are not yet moving, for example around 2200 hours. The position of pin 73 on moon phase drive disc 75 determines this phase shift.

The drive mechanism can advantageously be uncoupled after the jump at midnight so as to prevent any collision.

Preferably, moon phase mechanism 30 and date drive mechanism 40 are shifted by several hours, particularly 12 hours, so as to spread out energy consumption over the day, and to prevent any interference of the mechanisms around midnight. In fact, as the moon phase indicator is less precise than the other time or date indications, it can be shifted by several hours without any problem.

Drive wheel 71 completes one revolution in 24 hours. The moon phase is coupled, driven in dragging manner and changes at the selected moment during construction.

The date jump is performed instantaneously at midnight.

In short, with the use of a common drive mechanism 10 according to the invention it is easy to obtain two different displays, of two different measurable quantities, with the same time source, in two different operating modes, and such that the consumption of energy is spread during in the day. The mechanism has a reduced number of components. It is easy to improve a mechanism already made in accordance with EP Patent No. 2 015 146, by combining it with a drive disc 75 according to the invention, with a reduced requirement for space and in a very economical manner.

In addition to the use of a common drive mechanism 10, the invention is characterized in that it also incorporates a common correction mechanism 100.

Movement 2 conventionally includes a stem 50 for winding and adjusting the time and date setting. This stem 50 has a wheel or sliding wheel 51 which, in a first pulled out position T2 of stem 50, meshes with an intermediate wheel 55 pivoting about an axis 56.

Advantageously, and in a similar manner to the drive mechanisms, the moon phase correction mechanism 300 and the date correction mechanism 400 also largely use a common correction mechanism 100, which has the same correction lever 15 used both for correcting the date, when stem 50 is operated clockwise, and for correcting the moon phase when stem 50 is operated anti-clockwise.

The assembled correction lever 15 includes a sliding lever 44 pivotably mounted on axis 56. Preferably, this mechanism 100 and in particular the correction lever 15 thereof, incorporates the features of the instantaneous release and rapid correction device of EP Patent No. 1 785 783 by the same Applicant.

This sliding lever 44 carries, on a first side of pivot 56, an arm provided with a V-shaped cut-out portion, and, on the other side of pivot 56, a pivot 45 carrying coaxially a corrector star wheel 46 on the one hand, and on the other hand, a lever wheel 52, which meshes with intermediate wheel 55 driven by winding stem 50.

Corrector star wheel 46 carries at least one, and preferably several, particularly three, radial fingers 48 whose trajectory, depending on the angular position of sliding lever 44, interferes or does not interfere with the inner toothing 81 of a date indicator 8, or interferes or does not interfere with the trajectory of a moon phase correction lever 38. This lever 38 is permanently pivoted back towards arbour 45 of corrector star wheel 46 by a return spring 39. This corrector star wheel 46 advantageously carries a lubrication channel 47.

According to the invention, in the absence of any resistant stress, a friction spring 54 causes lever wheel 52 and corrector star wheel 46 to pivot integrally. Thus, if, on the side of common drive mechanism 10, date drive finger 78 is already meshed with toothing 81 of date indicator 8, there is a risk of a collision if a date correction is then started. The sliding of said friction spring 54 thus protects the two date drive and correction mechanisms 40 and 400. The same is true for the protection of moon phase drive and correction mechanisms 30 and 300.

Therefore, friction spring 54 is preloaded such that the torque that it applies to secure lever wheel 52 and corrector star wheel 46 to each other, applied to a finger 48 thereof abutting on the date toothing 81, is lower than the lowest of the torques, or transmitted by movement 2 to drive finger 78 of date drive mechanism 40, or applied by release spring 91 to cam 74 via release lever 9.

The rest position of this sliding lever 44 is a neutral position which does not interfere, either with the date mechanism, or with the moon phase mechanism.

In a conventional manner, a control lever of the time-setting mechanism of the movement, not shown in the Figures, may occupy three distinct positions according to the relative positions of stem 50 and a pull-out piece which is not shown in the Figures. This control lever carries the time-setting train. An arbour 19 of one of the wheels of the train moves in a V-shaped groove 18 comprised in a small lever 17, which pivots on a fixed arbour 16. This small lever 17 carries a stud 41 which is housed in a V-shaped cut-out portion 49 comprised in sliding lever 44, for holding the latter in place.

In the neutral position, arbour 19 is in the corner of the V of groove 18, and stud 41 is in the hollow at the top of the V of cut-out portion 49.

When stem 50 is in position T2 for correcting the moon phase or date, the time-setting control lever pivots, and consequently arbour 19 moves small lever 17 and its stud 41 away from sliding lever 44. Arbour 19 is then in contact with the end of groove 18 closest to date indicator 8 and the position of stud 41 depends on the direction of rotation imparted to stem 50.

Figure 3:
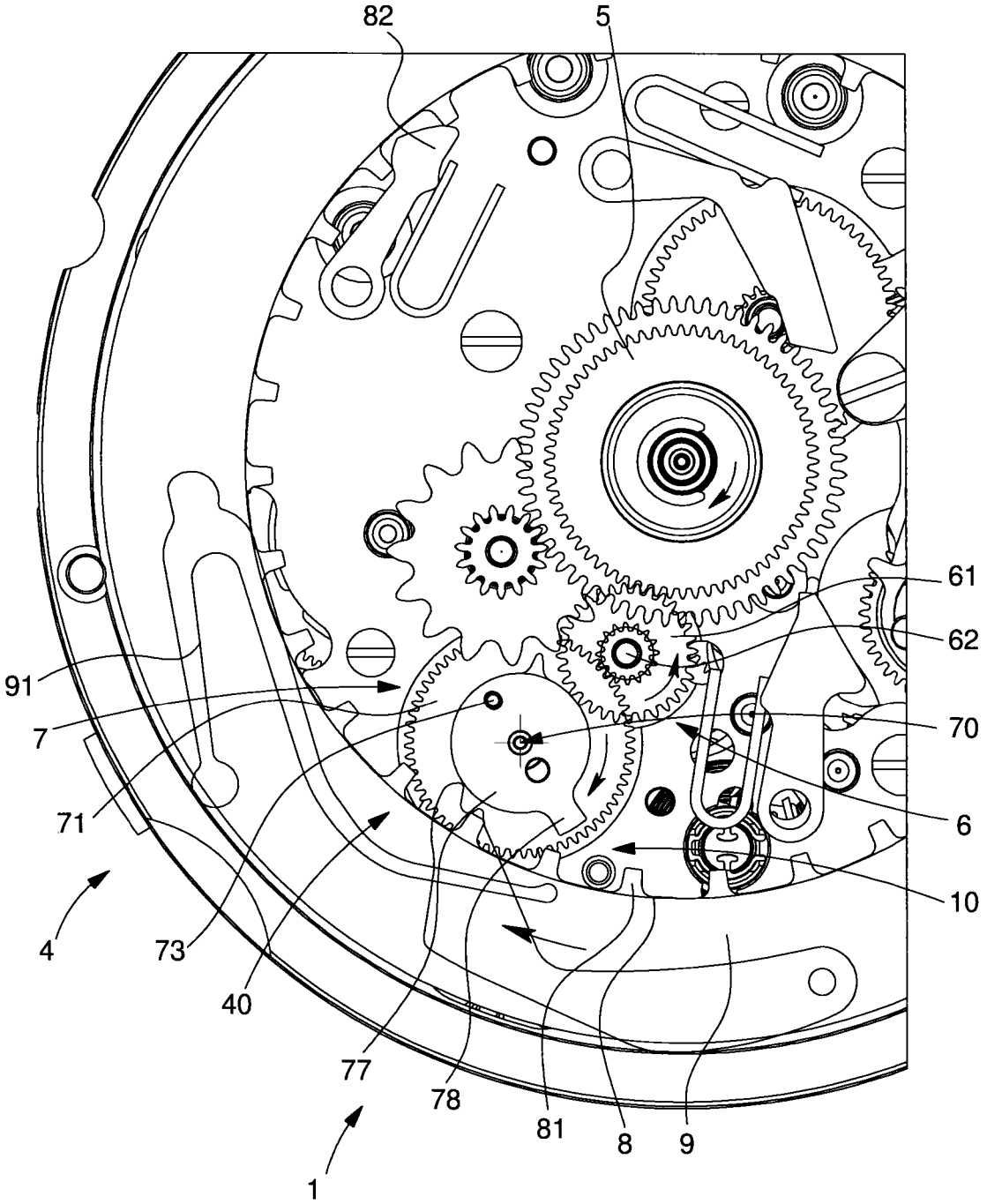
FIG. 3 shows a schematic, partial, front view of a detail of the timepiece of FIG. 1 with a common drive mechanism, and the operation of the date drive mechanism.

When stem 50 pivots clockwise to perform a date correction, stud 41 is then in contact with the end of cut-out portion 49 closest to the date indicator. Intermediate wheel 55 then pivots anti-clockwise, and lever wheel 52 and corrector star wheel 46 pivot clockwise, as seen in FIG. 3. A finger 48 of the corrector star wheel can then abut on one tooth of toothing 81 of date indicator 8 to move said indicator one step forward.

Figure 4:
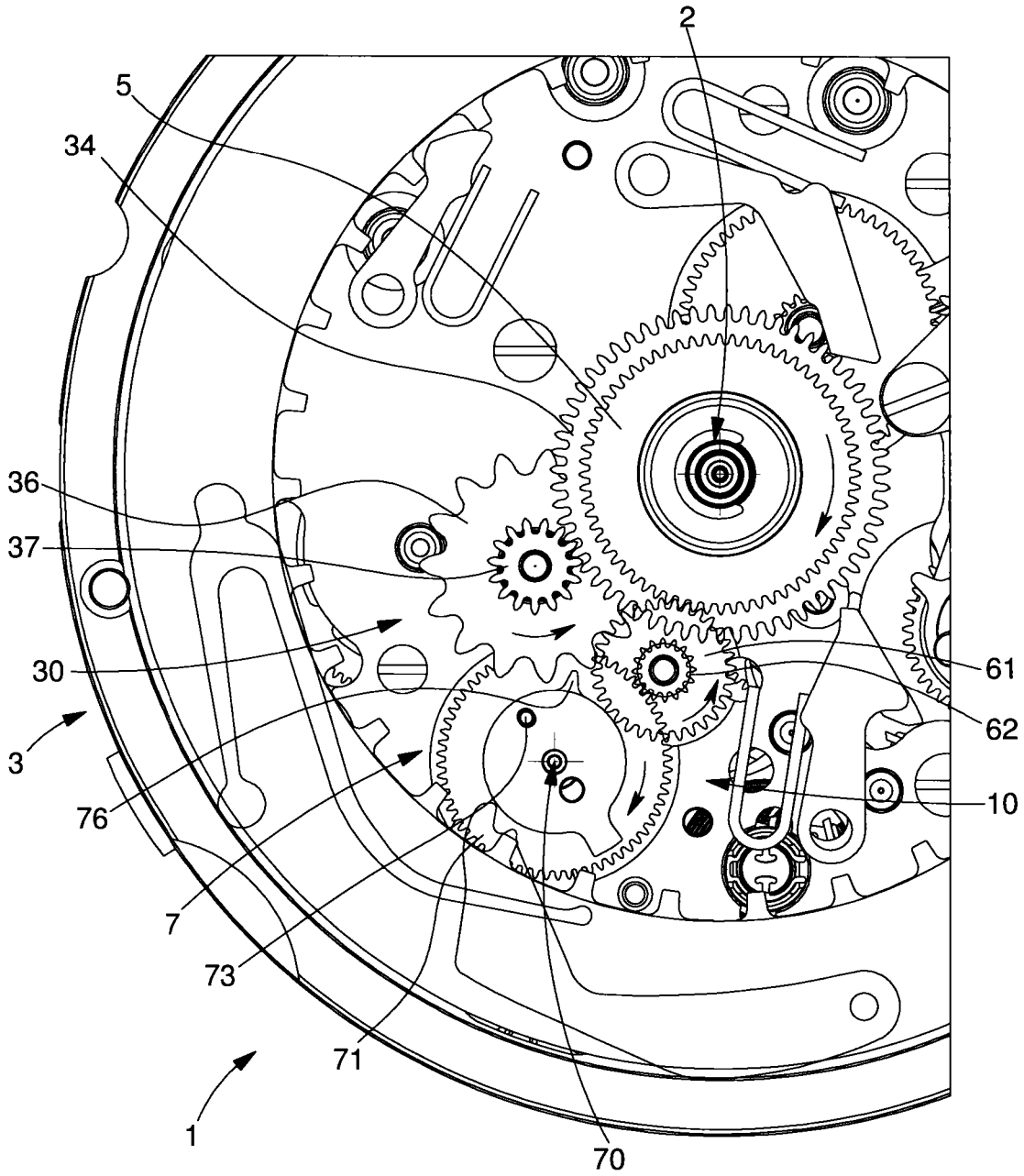
FIG. 4 shows a schematic, partial, front view of a detail of the timepiece of FIG. 1 with the common drive mechanism thereof, and the operation of the moon phase drive mechanism.
Figure 5:
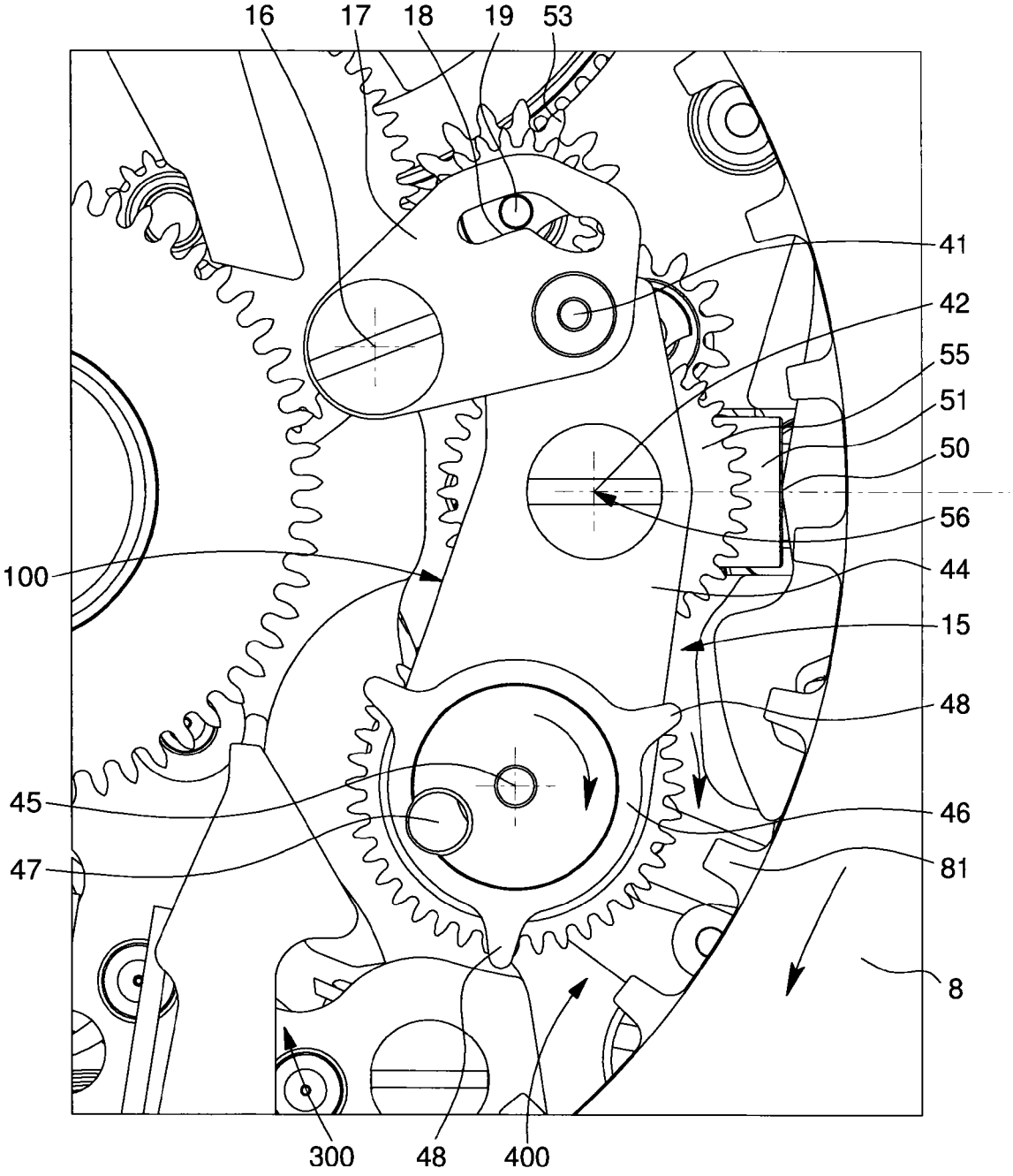
FIG. 5 shows a schematic, partial, front view of a detail of the timepiece of FIG. 1 with a common correction mechanism, and the operation of the date correction mechanism.
Figure 6:
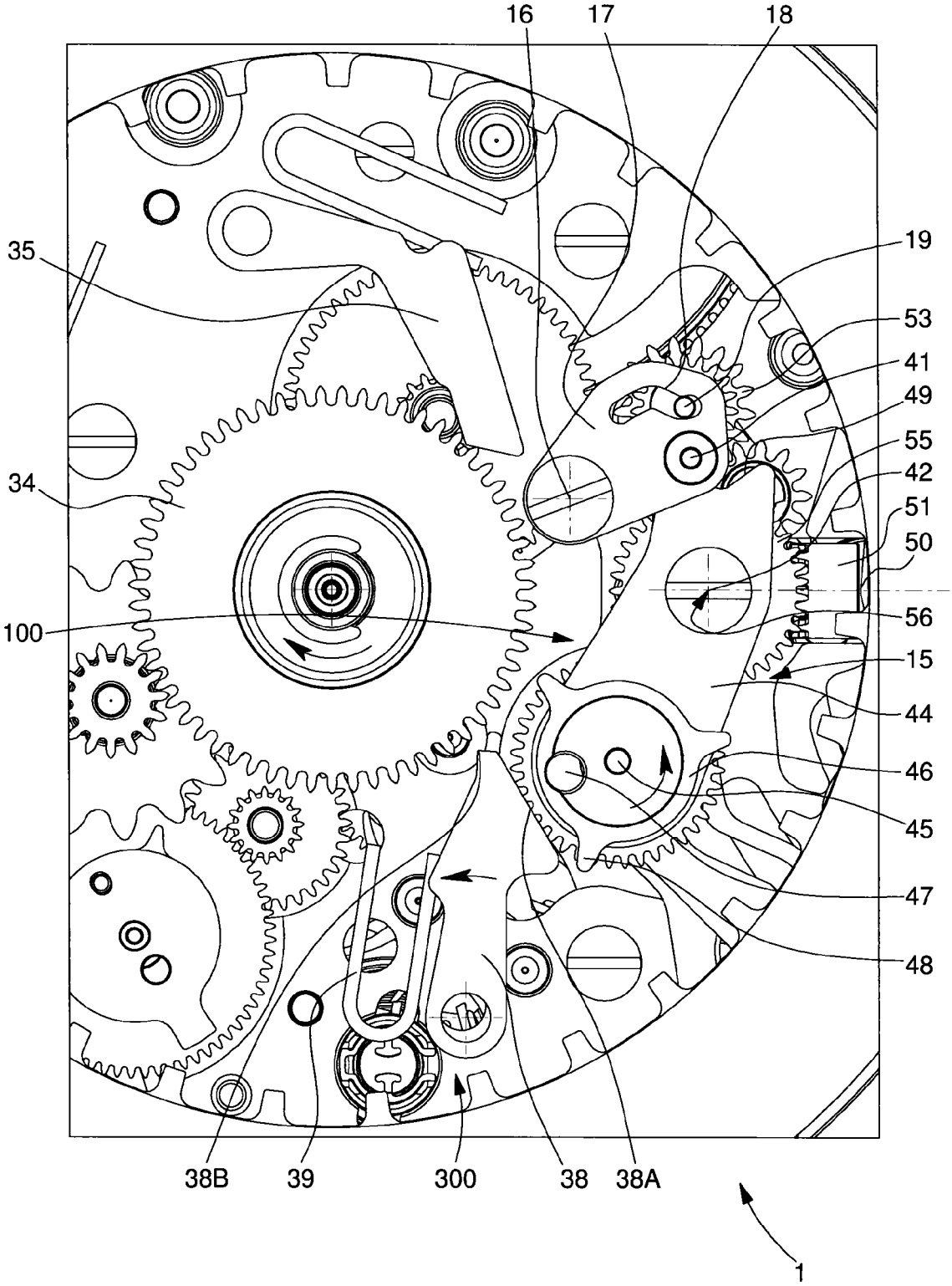
FIG. 6 shows a schematic, partial, front view of a detail of the timepiece of FIG. 1 with a common correction mechanism, and the operation of the moon phase correction mechanism.
Figure 7:
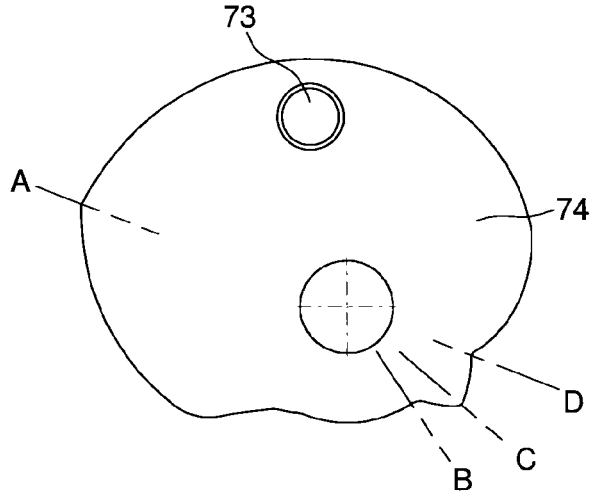
FIG. 7 shows a schematic front view of a cam comprised in the common drive mechanism according to the invention.
Figure 8:
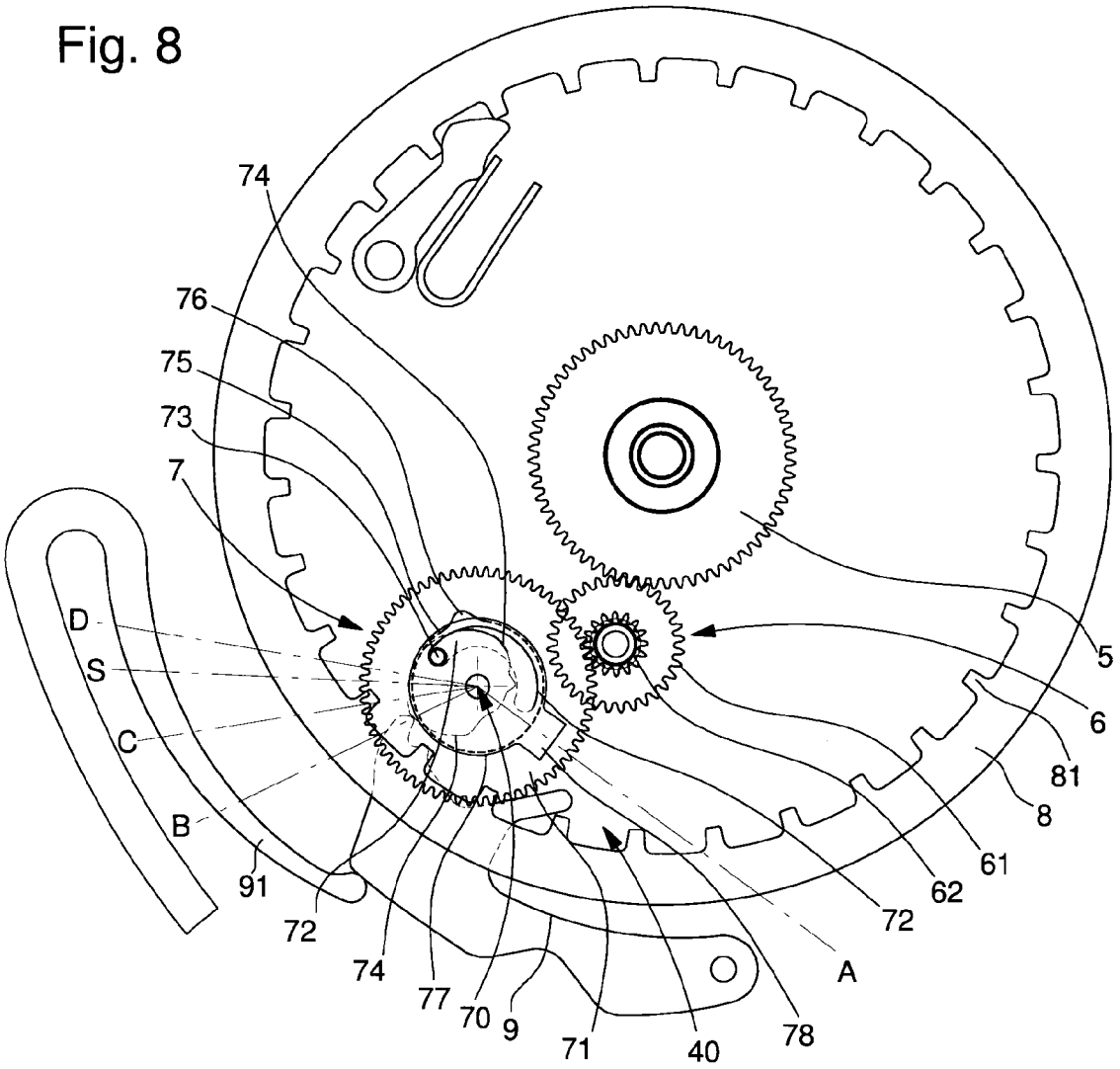
FIGS. 8, 9 and 10 show schematic, partial, front views of three operating steps of the common drive mechanism, showing different positions of a drive wheel set comprised therein, which includes the cam of FIG. 7, a moon phase drive disc carrying a radial finger, and a date drive disc also carrying a radial drive finger, pivotally moveable together relative to an oblong groove in a drive wheel.
Figure 9:
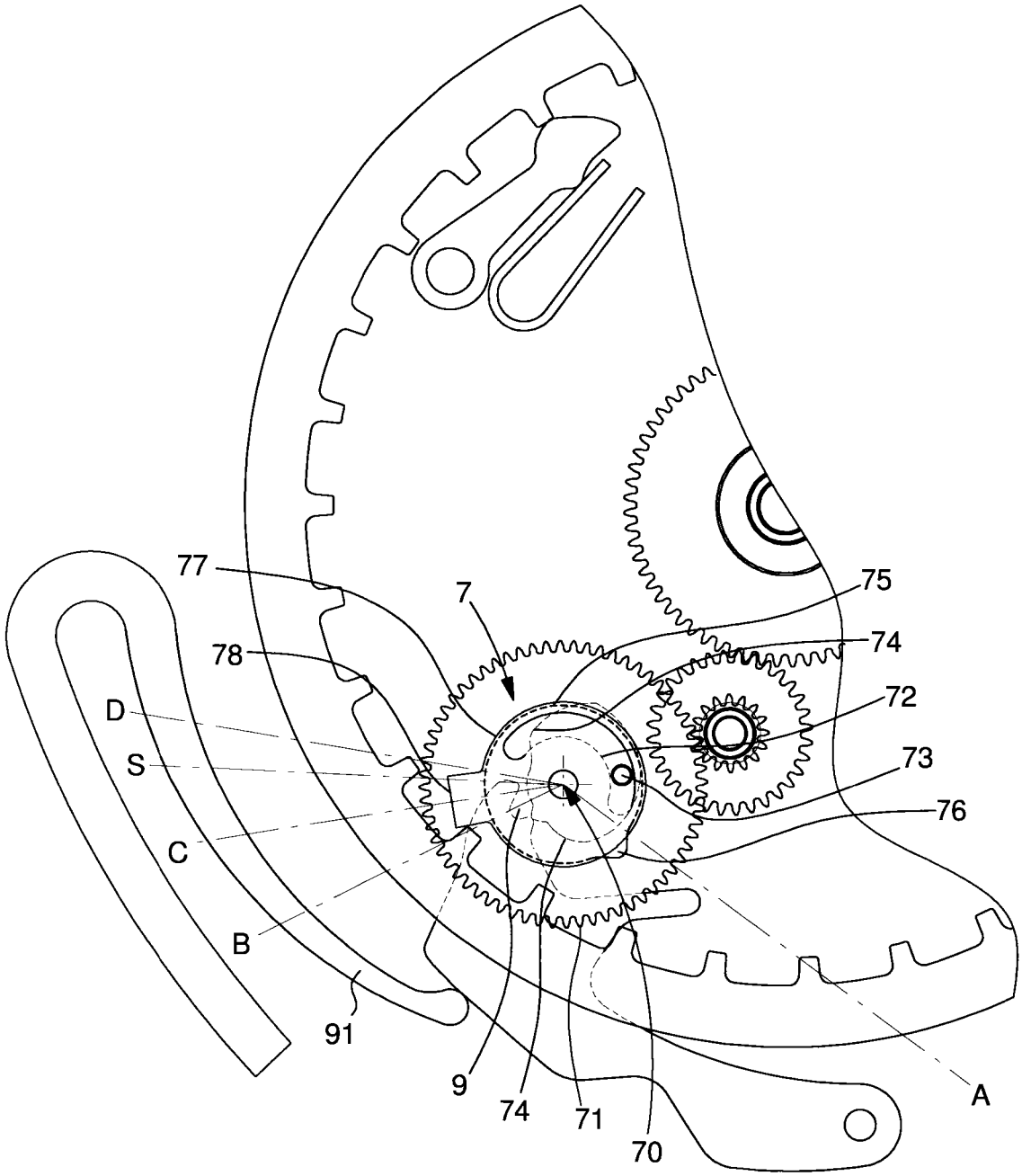
Figure 10:
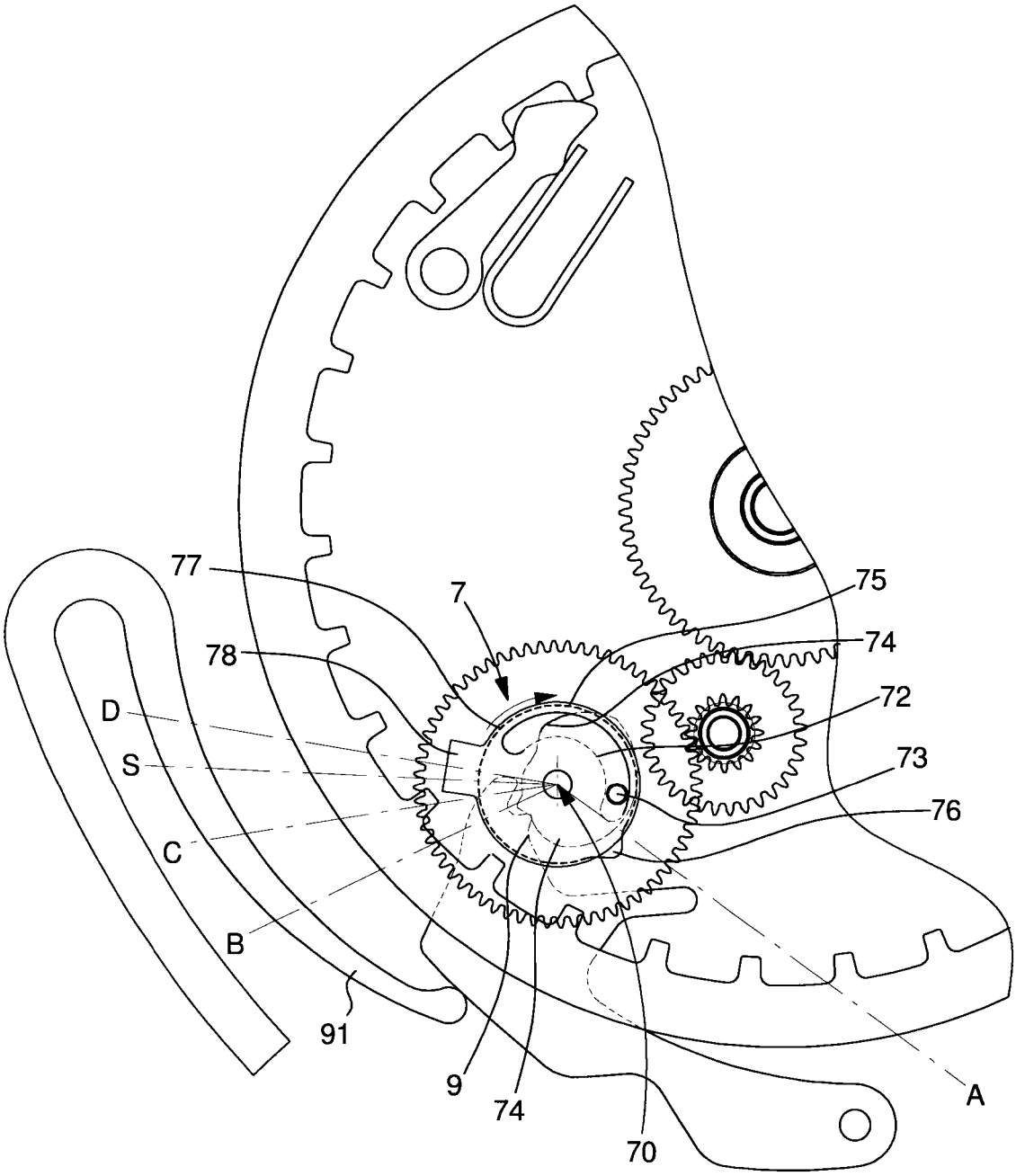
Figure 11:
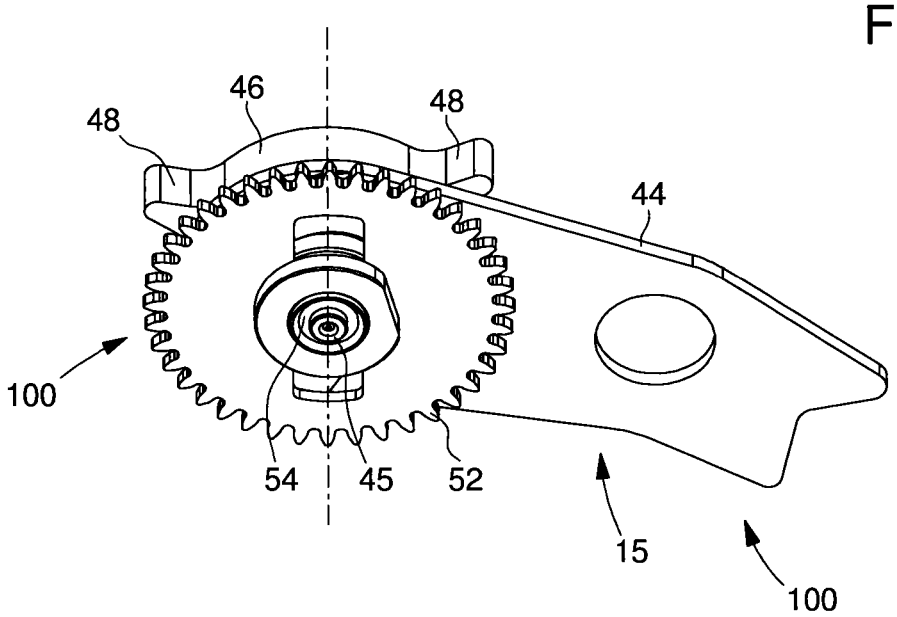
FIG. 11 show a schematic, partial, perspective view of a detail of a correction lever, comprised in a common correction mechanism, said correction lever carrying an intermediate lever wheel and a correction star wheel connected to each other by a friction spring.
Figure 12:
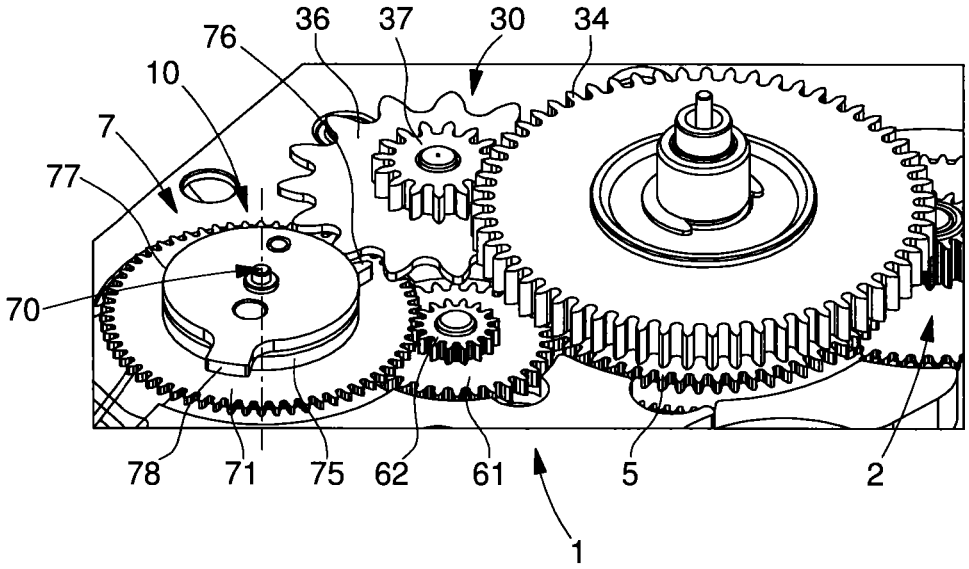
FIG. 12 shows a schematic, partial and perspective view of a detail of the common drive mechanism, showing the superposition of certain of the components of the drive wheel set shown in FIGS. 8 to 10.

When stem 50 pivots anti-clockwise to perform a moon phase correction, stud 41 is in contact with the end of cut-out portion 49 the most opposite date indicator 8, intermediate wheel 55 then pivots clockwise, and lever wheel 52 and corrector star wheel 46 pivot anti-clockwise, as seen in FIG. 4, around the pivot pin 45 thereof.

Depending on the angular position of sliding lever 44, the trajectory of a radial finger 48 of corrector star wheel 46 interferes or does not interfere with the trajectory of a moon phase corrector lever 38, which is pivoted back towards arbour 45 of corrector star wheel 46.

In pivoting, a finger 48 of corrector star wheel 46 abuts on a face or a cam 38A comprised in moon phase correction lever 38, to cause the latter to pivot anti-clockwise, against a return spring 39. Each time that a finger 48 pushes moon phase correction lever 38, the latter drives, via a beak 38B comprised therein, one tooth of a moon star wheel 34, commonly with 59 teeth, which is held by a jumper spring 35. It is therefore easily possible to adjust the moon phase to its exact representation, by a rapid operation. During this entire operation, at the other end of sliding lever 44, small lever 17, pivotally mounted about an axis 16, is in abutment, via the stud 41 thereof, on an area of cut-out portion 49 which is the furthest from toothing 81 of date indicator 8.

If, on the common drive mechanism 30 side, date drive finger 76 is already meshed with the toothing of star wheel 36, which is directly connected to moon phase wheel 34, there is a risk of a collision if a moon phase correction is then started. The sliding of said friction spring 54 thus protects the two moon phase drive and correction mechanisms 30 and 300.

Therefore, friction spring 54 is preloaded such that the torque that it applies to secure lever wheel 52 and corrector star wheel 46 to each other, applied to finger 38B of lever 38 on which a finger 48 of corrector star wheel 45 abuts, is lower than the lowest of the torques, or transmitted by movement 2 to drive finger 76 of moon phase drive mechanism 30, or applied by release spring 91 to cam 74 via release lever 9.

Since each direction of rotation of stem 50 corresponds to the correction of a different member, each member can only be corrected in a single direction, which improves operating security. The only backward corrections are thus those which are performed by action on the motion work, in the pulled-out position T3 of stem 50.

In pulled-out position T3 of stem 50, arbour 19 is in contact with the end of groove 18 the furthest from the date indicator, and stud 41 is in the hollow at the top of the V of cut-out portion 49.

The combination of the use of a mechanism according to EP Patent No. 2 015 146 and of friction spring 54 according to the present invention prevents the risk of any inadvertent operation, particularly in the opposite direction to the normal direction of adjustment, by an adjusting action of the motion work when a drive or correction wheel set is already engaged with a toothing, either of the date or moon phase mechanism.

The mechanism according to the invention allows the moon phase and date corrections to be performed entirely independently and safely.

The invention also concerns a timepiece 1000 including a display mechanism 1 of this type and a timepiece movement 2, said mechanism 1 being driven by said movement 2.

What is claimed is:

1. A timepiece mechanism for displaying and correcting a state of two different time measurable quantities for a timepiece or a scientific apparatus comprising:

a timepiece movement, including or driving at least a first display mechanism to display a first measurable time quantity and a second display mechanism to display a second measurable time quantity, said movement including an adjusting member, and wherein said first display mechanism and said second display mechanism respectively include a first drive mechanism and a second drive mechanism, which share a common drive mechanism, which is driven by said movement, and which controls a driving of one of said first display mechanism and said second display mechanism by instantaneous jumps under an action of a jumper spring, and which controls a driving of the other of said first display mechanism and said second display mechanism in a dragging manner, and wherein said first display mechanism and said second display mechanism respectively include a first correction mechanism and a second correction mechanism, which share a common correction mechanism, which is driven by said adjusting member, which is independent of said common drive mechanism, and which includes at least one friction safety device preventing any correction being performed when an instantaneous display jump is being prepared or carried out, wherein said common drive mechanism includes, pivoting integrally with each other relative to an oblong groove of a drive wheel directly or indirectly driven by said movement, a cam on which a release spring permanently exerts stress via a release lever, a disc driving said first display mechanism and carrying at least one radial drive finger, and a disc driving said second display mechanism and carrying a radial drive finger, said cam comprising steep ramps to instantaneously operate said drive disc for said second display mechanism, whereas said disc driving said first display mechanism only experiences slow movements of a pin moving in said oblong groove and pivoting integrally with a stack, coaxial to said drive wheel on an arbour, including said cam, said drive disc of said first display mechanism and said drive disc of said second mechanism, a travel of said pin in said oblong aperture defining a period during which said disc is not driven.

2. The timepiece display and correction mechanism according to claim 1, wherein said common correction mechanism includes a correction lever which carries an intermediate lever wheel driven by said adjusting member and a correction star wheel connected to said intermediate lever wheel by at least one spring forming said friction device.

3. The timepiece display and correction mechanism according to claim 1, wherein a resistance stress exerted by said friction device of said common correction mechanism is less than that exerted by said common drive mechanism.

4. The timepiece display and correction mechanism according to claim 1, wherein, relative to said common drive mechanism, said first drive mechanism and said second drive mechanism are adjusted such that a change of display of said first display mechanism to display the first measurable time quantity and of said second display mechanism to display the second measurable time quantity is carried out with a time shift.

5. The timepiece display and correction mechanism according to claim 4, wherein the change of display of said first display mechanism to display the first measurable time quantity and of said second display mechanism to display the second measurable time quantity is carried out with a time shift of at least two hours, said time shift being adjustable at a time that said timepiece display and correction mechanism is constructed by angularly shifting the drive fingers comprised in each of said first and second display mechanisms.

6. The timepiece display and correction mechanism according to claim 1, wherein said first display mechanism is a moon phase display comprising a dragging moon phase drive mechanism and a moon phase correction mechanism, and said second display mechanism is a date mechanism comprising an instantaneous jumping date drive mechanism and a date correction mechanism.

7. The timepiece including a timepiece display and correction mechanism according to claim 1, and a timepiece movement, wherein said timepiece display and correction mechanism is driven by said movement.

* * * * *